US006073279A

United States Patent [19]

Skaler

[11] Patent Number: 6,073,279

[45] Date of Patent: Jun. 13, 2000

[54] BED PATIENT POSITIONING ARRANGEMENT

[75] Inventor: Aileen Skaler, Philadelphia, Pa.

[73] Assignee: Innovative Medical Products Inc., Plainville, Conn.

[21] Appl. No.: 09/210,699

[22] Filed: Dec. 14, 1998

[51] Int. Cl.[7] ..... A61G 7/10

[52] U.S. Cl. ..... 5/81.1 T; 5/81.1 R

[58] Field of Search ..... 5/81.1 T, 81.1 R; 414/921

[56] References Cited

U.S. PATENT DOCUMENTS

| | | | |
|---|---|---|---|
| 3,458,878 | 8/1969 | Combs | 5/81.1 T |
| 4,536,903 | 8/1985 | Parker | 5/81.1 T |
| 4,872,226 | 10/1989 | Lonardo | 5/81.1 T |
| 4,908,889 | 3/1990 | Lonardo | 5/81.1 T |
| 5,005,231 | 4/1991 | Lonardo | 5/81.1 T |
| 5,168,587 | 12/1992 | Shutes | 5/81.1 T |

*Primary Examiner*—Terry Lee Melius
*Assistant Examiner*—Fredrick Conley

[57] ABSTRACT

A turn strap of surgical grade elastic material having Velcro hooks and loops on opposing ends thereof is positioned under the patient on a hospital bed. One end of the strap is arranged around the side rail on one side of the bed and the other end of the strap is arranged around the side rail on the other side of the bed.

2 Claims, 4 Drawing Sheets

BED PATIENT POSITIONING ARRANGEMENT

BACKGROUND OF THE INVENTION

Movement of patients in a hospital bed is often quite difficult especially when the patient is mentally and or physically impaired.

One example of the use of an elongated strap to assist in the rotation of a patient in a hospital bed is found in U.S. Pat. No. 5,153,959 entitled "Method and Apparatus for Patient Assisted Movement in Convalescing Bed".

The use of such an elongated strap is made difficult when the patient is larger than the person attempting to rotate the patient, without additional assistance.

It would be advantageous to provide a strap that cooperates with the hospital bed structure to provide mechanical advantage in rotating the patient without causing damage to the patient or physical strain to the person attempting the rotation.

The purpose of the invention is to describe an efficient and economical "turn strap" that attaches to the side rails of a standard hospital bed to assist the attendant in rotating the patient with the least amount of strain on the attendant during the process.

SUMMARY OF THE INVENTION

A turn strap of surgical grade elastic material having Velcro hooks and loops on opposing ends thereof is positioned under the patient on a hospital bed. One end of the strap is arranged around the side rail on one side of the be and the other end of the strap is arranged around the side rail on the other side of the bed. To rotate the patient onto his side, one end of the strap is removed from the rail, the rail is lowered and the end of the strap is grasped by the attendant to support the patient and to assist the rotation. When the patient is on his side, the free end of the strap is attached to the top of the opposite side rail.

DESCRIPTION OF THE PREFERRED EMBODIMENTS

Figure 1:
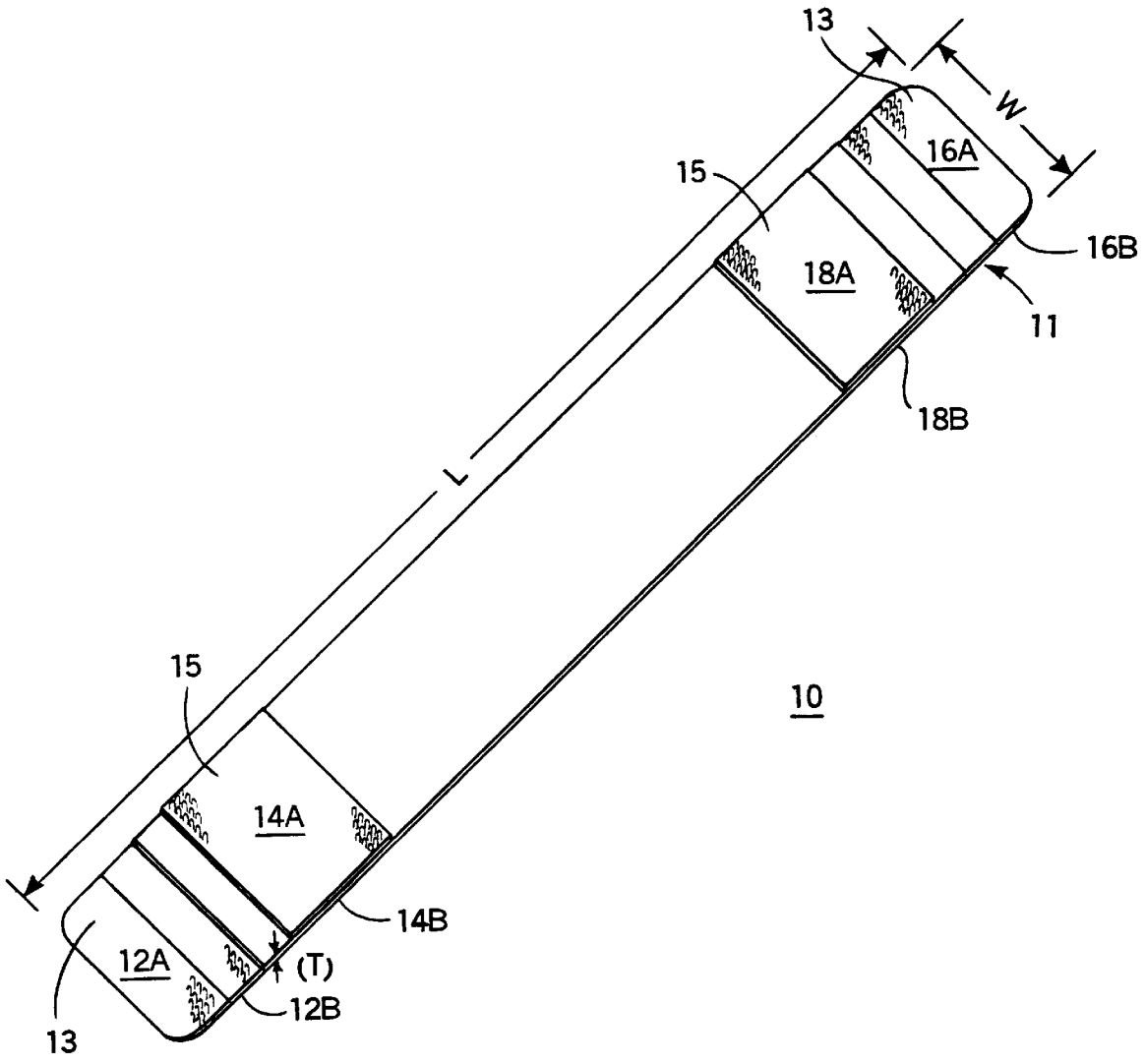
FIG. 1 is a top perspective view of the turn strap according to the invention.

As best seen in FIG. 1, the turn strap 10 consists of a surgical grade rubber in a rectangular configuration 11 defining a major dimension L minor dimension W and thickness T, as indicated. A Velcro pad 12A is attached to one side of the strap at one end and comprises a plurality of hooks, as indicated at 13, and a similar pad 12B is attached to the opposite side of the strap 10. A Velcro pad 14A is attached next to the pad 12A and includes a plurality of loops, as indicated at 15 and a similar pad 14B is attached to the opposite side of the strap 10. A Velcro pad 16A is attached to the opposite end of the strap 10 and includes a plurality of similar hooks 13 with a Velcro pad 18A having similar loops 15 adjacent thereto. Similar Velcro pads 16B, 18B are attached to the opposite sides to facilitate attachment of the strap 10 without requiring a specific orientation of the strap during attachment to a substrate surface. The length of dimension L, is selected to extend across the width of a hospital bed 19, shown in FIG. 2 and the width of dimension W and thickness of dimension T are selected for strength and comfort purposes.

Figure 2:
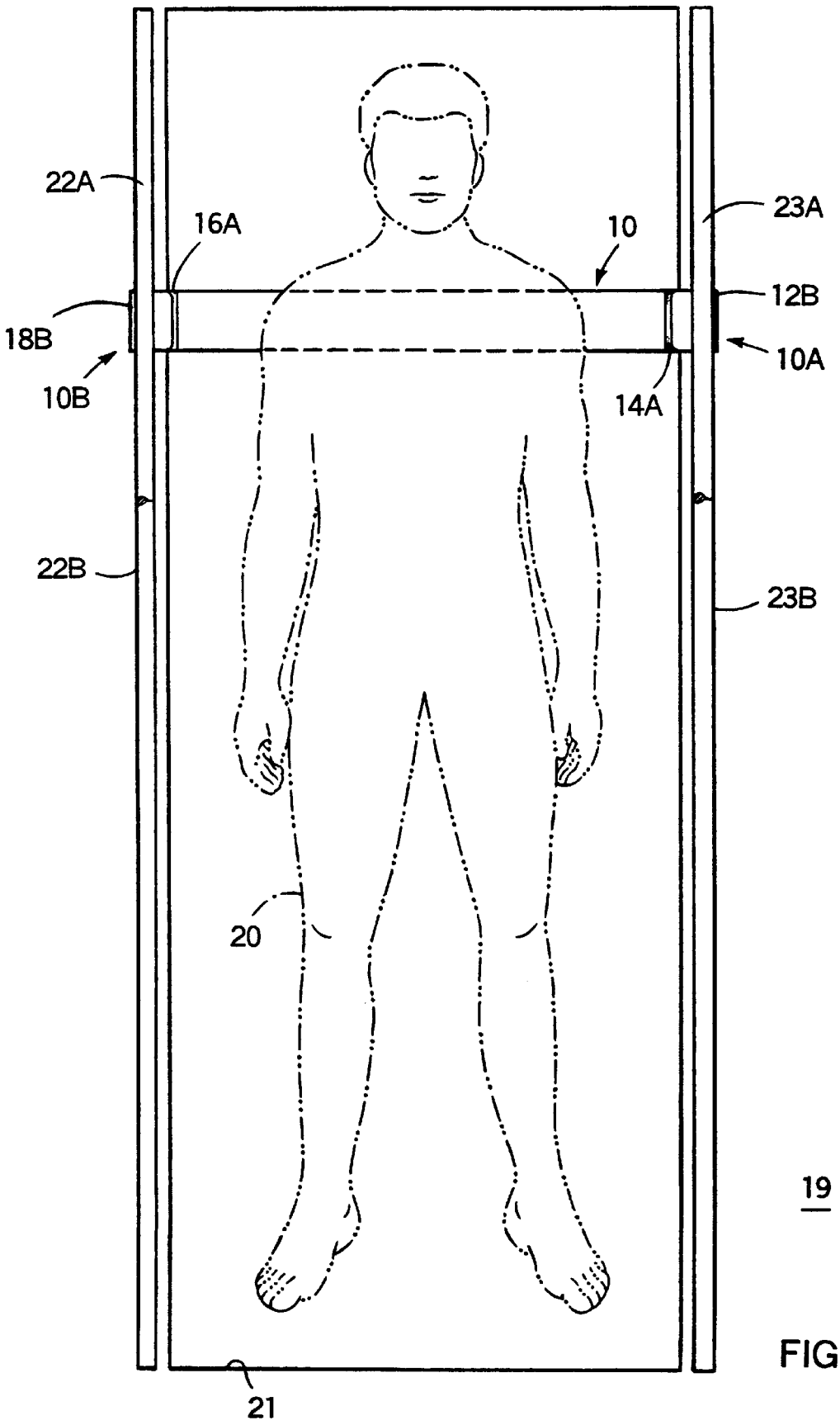
FIG. 2 is top planar view of a hospital bed containing a patient in a supine position on the turn strap of FIG. 1.

As shown in FIG. 2, the strap 10 is arranged on the mattress support 21 and is attached at opposite ends to the right bottom side rail 22B and left bottom side rail 23B. The left and right designations are based on the left and right sides of the patient 20 indicated in phantom. The right top side rail 22A is coextensive with and extends along the top of the right bottom side rail and the left top side rail 23A is coextensive with and extends along the top of the left bottom side rail 23B. For releasable attachment between the side rails and the strap, the opposite ends 10A, 10B of the strap 10 are wrapped around the side rails such that the pad 16A fastens to the pad 18B at end 10A and the pad 12A fastens to the pad 12B at end 10B. The patient 20 is arranged on his back over the strap, as depicted in FIG. 2. When it is desired to rotate the patient to his left side, the procedure shown in FIG. 3 is employed.

Figure 3:
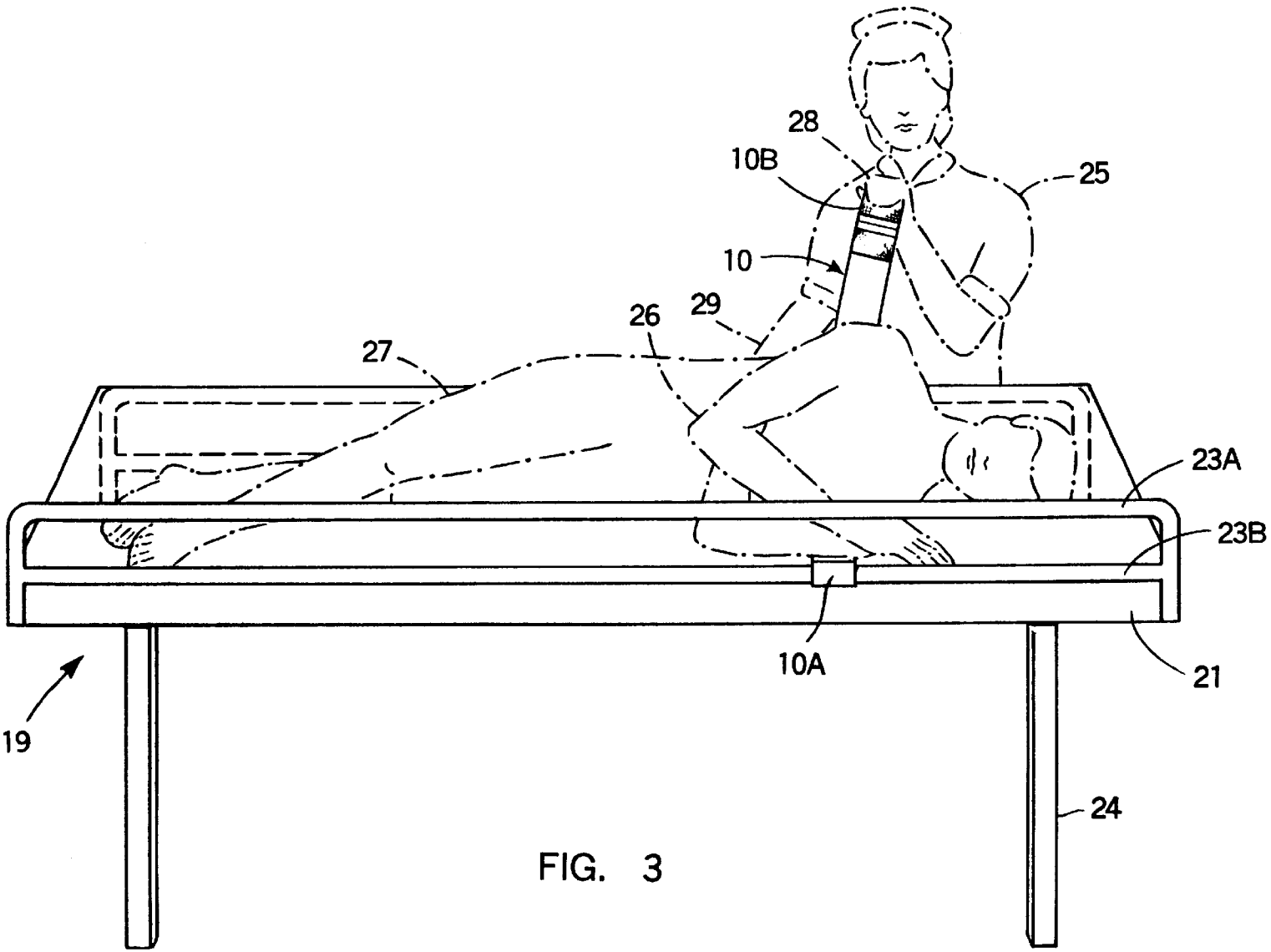
FIG. 3 is a side perspective view of the patient shown in FIG. 2 partially rotated to the side position.

In FIG. 3, the hospital bed 19 is shown to consist of the mattress support 21 resting upon opposing pairs of legs 24, as viewed from the left side of the patient 20 with the left top rail 23A superjacent the left bottom side rail 23B and with the end 10A attached to the bottom rail 23B. To rotate the patient 20 over to his left side, the attendant 25 first crosses the patient's right arm over his left arm as indicated at 26 and crosses his right leg over his left leg as indicated at 27. The attendant next releases the end 10B from the right bottom rail 22B (FIG. 2) and lifts the end 10B with one hand, as indicated at 28, to apply pressure to the back of the patient 20 while applying pressure to the shoulder of the patient with the other hand as indicated at 29. With the patient held in this position, the attendant then fastens the end 10B to the left top rail 23A by wrapping the Velcro pads (not shown) in the manner described earlier with reference to FIG. 2.

Figure 4:
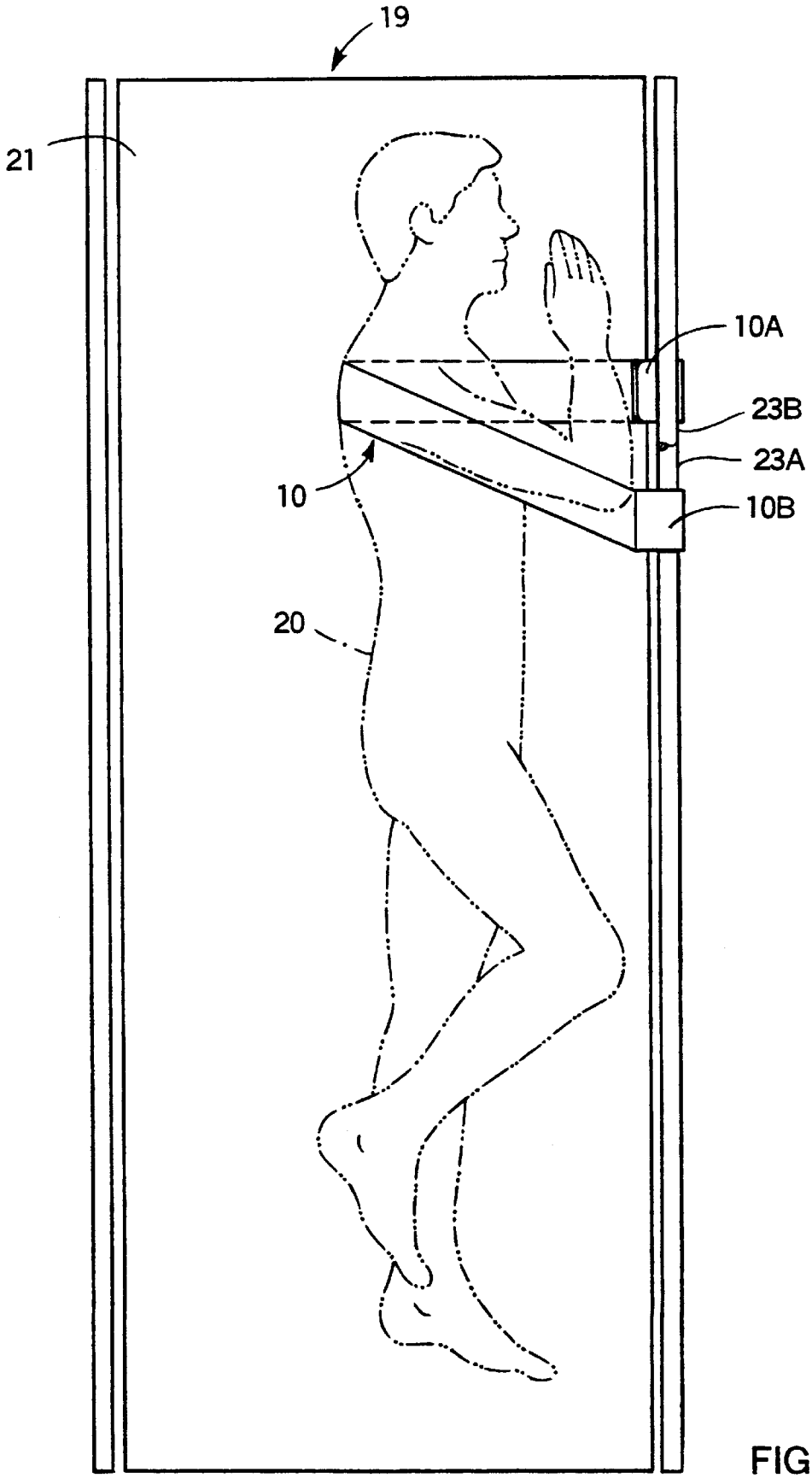
FIG. 4 is a top planar view of the hospital bed of FIG. 2 with the patient arranged on a side position on the turn strap in accordance with the invention.

The patient 20 is shown on his left side on the mattress support 21 on the bed 19 in FIG. 4 with the strap 10 arranged around the patient to hold the patient securely and comfortably thereon. The end 10A of the strap 10 remains attached to the left bottom side rail 23B and the opposite end 10B is shown newly attached to the left top side rail 23A. To rotate the patient in the opposite direction to his right side, the opposite steps are undertaken starting from the supine position of FIG. 2.

A turn strap has herein been described that assists in the rotation of a bed-ridden patient while at the same time providing support for the patient to allow an attendant to change the location of one end of the strap while maintaining control of the patient's position at all times.

What is claimed is:

1. A strap for assisting in rotation of a patient in a convalescing bed comprising:

an elongated rectangle of textured material having a predetermined thickness, width and length, said width being greater than said thickness and said length being greater than said width;

a plurality of first Velcro hooks and a plurality of first Velcro loops on a first end of said rectangle, said first Velcro hooks arranged in abutment with said first Velcro loops on said first end of said rectangle;

a plurality of second Velcro hooks and a plurality of second Velcro loops on a second end of said rectangle, said second Velcro hooks arranged in abutment with said second Velcro loops on said second end of said rectangle, said first Velcro hooks are arranged outside said first Velcro loops to facilitate arranging said first end of the rectangle around a first bed rail and attaching said first Velcro hooks to said first Velcro loops for attaching said first end of the rectangle to a first bed rail and said second Velcro hooks are arranged outside said second Velcro loops to facilitate arranging said second end of the rectangle around a second bed rail and attaching said second Velcro hooks to said second Velcro loops for attaching said second end of the rectangle to a second bed rail opposite said first bed rail.

2. A method for assisting in the rotation of a patient in a convalescing bed comprising the steps of:

providing an elongated strap having first Velcro hooks and first Velcro loops on one end of the strap and second Velcro hooks and second Velcro loops on an opposite end of said strap;

arranging said one end of said strap around a bottom of a first bed rail on one side of a convalescing bed and fastening said first Velcro hooks and loops to secure said one end to said bottom of said first bed rail;

arranging said opposite end of said strap around a bottom of a second bed rail on an opposite side of a convalescing bed and fastening said second Velcro hooks and loops to secure said opposite end to said bottom of said second bed rail opposite said first bed rail;

arranging a patient on his backside on said convalescing bed over said strap and removing said one end of said strap from said bottom of first bed rail;

crossing an arm on one side of the patient over a leg on the other side of the patient;

lifting said one end of said strap and applying pressure to said backside of said patient to rotate said patient onto his other side; and arranging said one end of said strap around a top of said second bed rail fastening said first Velcro hooks and loops to secure said one end to said top of said second bed rail to support said patient on his other side.

* * * * *